US008438853B2

(12) United States Patent
Green et al.

(10) Patent No.: US 8,438,853 B2
(45) Date of Patent: May 14, 2013

(54) COMBUSTOR END CAP ASSEMBLY

(75) Inventors: Andrew Green, Jupiter, FL (US); Peter Stuttaford, Jupiter, FL (US); Yan Chen, Sammamish, WA (US); Hany Rizkalla, Stuart, FL (US)

(73) Assignee: Alstom Technology Ltd., Baden (CH)

( * ) Notice: Subject to any disclaimer, the term of this patent is extended or adjusted under 35 U.S.C. 154(b) by 1012 days.

(21) Appl. No.: 12/247,615

(22) Filed: Oct. 8, 2008

(65) Prior Publication Data

US 2009/0188255 A1 Jul. 30, 2009

Related U.S. Application Data

(60) Provisional application No. 61/024,319, filed on Jan. 29, 2008.

(51) Int. Cl.
*F02C 1/00* (2006.01)
*F02G 3/00* (2006.01)

(52) U.S. Cl.
USPC ..... 60/746; 60/737; 60/752; 60/804

(58) Field of Classification Search ..... 60/737, 60/746, 747, 748, 752, 756, 772, 804
See application file for complete search history.

(56) References Cited

U.S. PATENT DOCUMENTS

| | | | | |
|---|---|---|---|---|
| 5,253,471 | A * | 10/1993 | Richardson | 60/804 |
| 5,274,991 | A * | 1/1994 | Fitts | 60/800 |
| 5,357,745 | A | 10/1994 | Probert | |
| 5,396,759 | A * | 3/1995 | Richardson | 60/804 |
| 5,509,270 | A * | 4/1996 | Pearce et al. | 60/740 |
| 5,941,076 | A * | 8/1999 | Sandelis | 60/752 |
| 5,956,955 | A * | 9/1999 | Schmid | 60/748 |
| 6,438,959 | B1 | 8/2002 | Dean et al. | |
| 6,497,105 | B1 * | 12/2002 | Stastny | 60/796 |
| 6,546,733 | B2 * | 4/2003 | North et al. | 60/772 |
| 6,923,002 | B2 | 8/2005 | Crawley et al. | |
| 6,978,618 | B2 * | 12/2005 | Pacheco-Tougas et al. | 60/752 |
| 7,036,316 | B2 * | 5/2006 | Howell et al. | 60/772 |
| 7,219,498 | B2 * | 5/2007 | Hadder | 60/752 |
| 7,328,582 | B2 * | 2/2008 | Sandelis et al. | 60/804 |
| 2006/0191268 | A1 * | 8/2006 | Widener et al. | 60/772 |

* cited by examiner

*Primary Examiner* — William H Rodriguez
*Assistant Examiner* — Carlos A Rivera
(74) *Attorney, Agent, or Firm* — Shook, Hardy & Bacon L.L.P.

(57) ABSTRACT

A combustor end cap assembly having an improved cooling configuration is disclosed. Embodiments of the present invention are directed towards an apparatus and method for cooling an effusion plate of the combustor end cap assembly. The combustor end cap assembly also incorporates an impingement plate having a plurality of cooling holes with the impingement plate positioned a predetermined distance from the effusion plate. The cooling fluid passes through the impingement plate and is directed towards and onto the effusion plate for cooling of the effusion plate.

16 Claims, 9 Drawing Sheets

COMBUSTOR END CAP ASSEMBLY

CROSS-REFERENCE TO RELATED APPLICATIONS

This application claims priority to U.S. Provisional Patent Application Ser. No. 61/024,319, filed on Jan. 29, 2008.

TECHNICAL FIELD

The present invention relates to gas turbine engines. More particularly, embodiments of the present invention relate to an apparatus and method for cooling an end cap assembly of a gas turbine combustion system.

BACKGROUND OF THE INVENTION

Gas turbine engines operate to produce mechanical work or thrust. One type of gas turbine engine is a land-based engine that has a generator coupled thereto which harnesses the mechanical work for the purposes of generating electricity. A gas turbine engine comprises at least a compressor section having a series of rotating compressor blades. Air enters the engine through an inlet and then passes through the compressor, where the rotating blades compress the air, thereby raising its pressure and temperature. The compressed air is then directed into one or more combustors where fuel is injected into the compressed air and the mixture is ignited.

The combustor can take on a variety of configurations. Typically combustors have one or more chambers where fuel and air are mixed and then ignited. In order to provide the lowest possible emissions, it is necessary to thoroughly mix the fuel and air, so as to burn as many fuel particles as possible. Also, due to the reaction temperatures of the combustion process, it is necessary to actively cool the combustion liner.

The hot combustion gases are directed from the combustion section to a turbine section by a transition duct. The hot combustion gases pass through the turbine, causing the turbine to rotate, where the turbine is in turn coupled to the compressor by a shaft located along an engine centerline.

SUMMARY

Embodiments of the present invention are directed towards a system and method for, among other things, providing an end cap assembly for a gas turbine combustor having a configuration capable of providing improved cooling to a surface of the end cap assembly that is exposed to the combustion process.

In one embodiment of the present invention, an end cap assembly is disclosed having an effusion plate with a first plurality of cooling holes and a first plurality of premix tube holes. An impingement plate having a second plurality of cooling holes and a second plurality of premix tube holes is located generally parallel to the effusion plate, but spaced apart by a first axial distance. A generally cylindrical sleeve extends from the effusion plate to and beyond the impingement plate. A plurality of premix tubes extend from the first plurality of premix tube holes in the effusion plate and through the second plurality of premix tube holes in the impingement plate to proximate a rear plate. A supply of cooling fluid, such as air, can be directed through the second plurality of cooling holes in the impingement plate and onto a backside of the effusion plate. The cooling fluid then passes through the first plurality of cooling holes in the effusion plate. The second plurality of cooling holes are positioned about the impingement plate so as to direct the supply of cooling fluid towards specific regions of the effusion plate.

In an alternate embodiment of the present invention, the end cap assembly further comprises a forward support structure positioned generally parallel to the impingement plate, a rear plate positioned generally parallel to the forward support structure and adjacent an end of the premix tubes. This embodiment also includes a flow shield located proximate the rear plate for minimizing the amount of cooling fluid that may get trapped in an area adjacent to the rear plate. This inclined wall portion also serves to redirect a portion of the cooling fluid towards the inlet of the plurality of premix tubes.

In yet another embodiment of the present invention, a method of providing cooling fluid to increase cooling flow to a portion of an end cap assembly is disclosed. The method comprises providing a combustor end cap assembly as previously disclosed and directing a supply of a cooling fluid, such as air, into the end cap assembly, around the plurality of premix tubes, and then directing the cooling fluid in a generally axial direction, through a second plurality of cooling holes in an impingement plate. The axial distance between the impingement plate from the effusion plate as well as the location and size of the second plurality of cooling holes are determined so as to improve the effectiveness of the cooling fluid distribution onto the effusion plate. The cooling fluid then passes through the first plurality of cooling holes in the effusion plate to cool the effusion plate.

Additional advantages and features of the present invention will be set forth in part in a description which follows, and in part will become apparent to those skilled in the art upon examination of the following, or may be learned from practice of the invention.

BRIEF DESCRIPTION OF THE SEVERAL VIEWS OF THE DRAWINGS

The present invention is described in detail below with reference to the attached drawing figures, wherein.

DETAILED DESCRIPTION

The subject matter of the present invention is described with specificity herein to meet statutory requirements. However, the description itself is not intended to limit the scope of this patent. Rather, the inventors have contemplated that the claimed subject matter might also be embodied in other ways, to include different components, combinations of components, steps, or combinations of steps similar to the ones described in this document, in conjunction with other present or future technologies.

Figure 1:
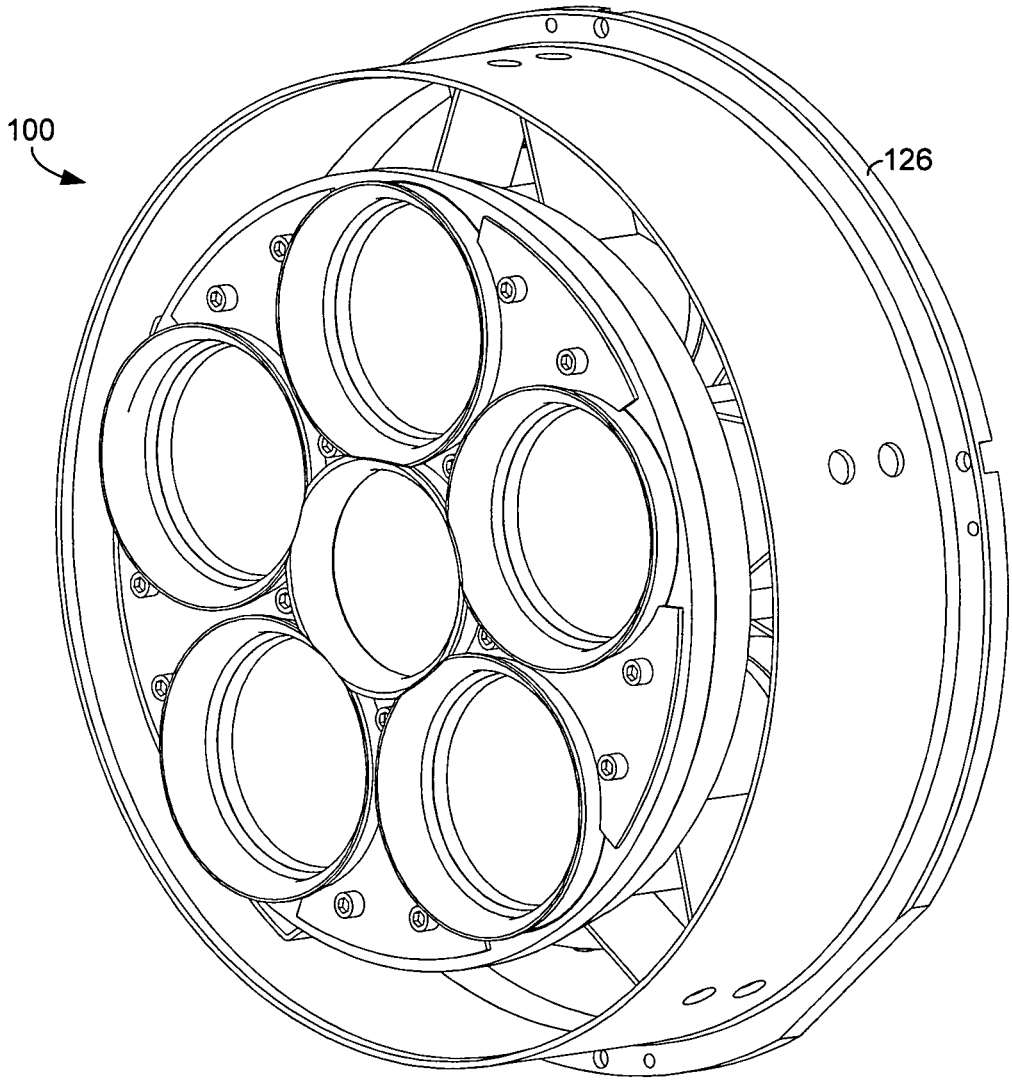
FIG. 1 depicts a perspective view of a combustor end cap assembly in accordance with an embodiment of the present invention.
Figure 2:
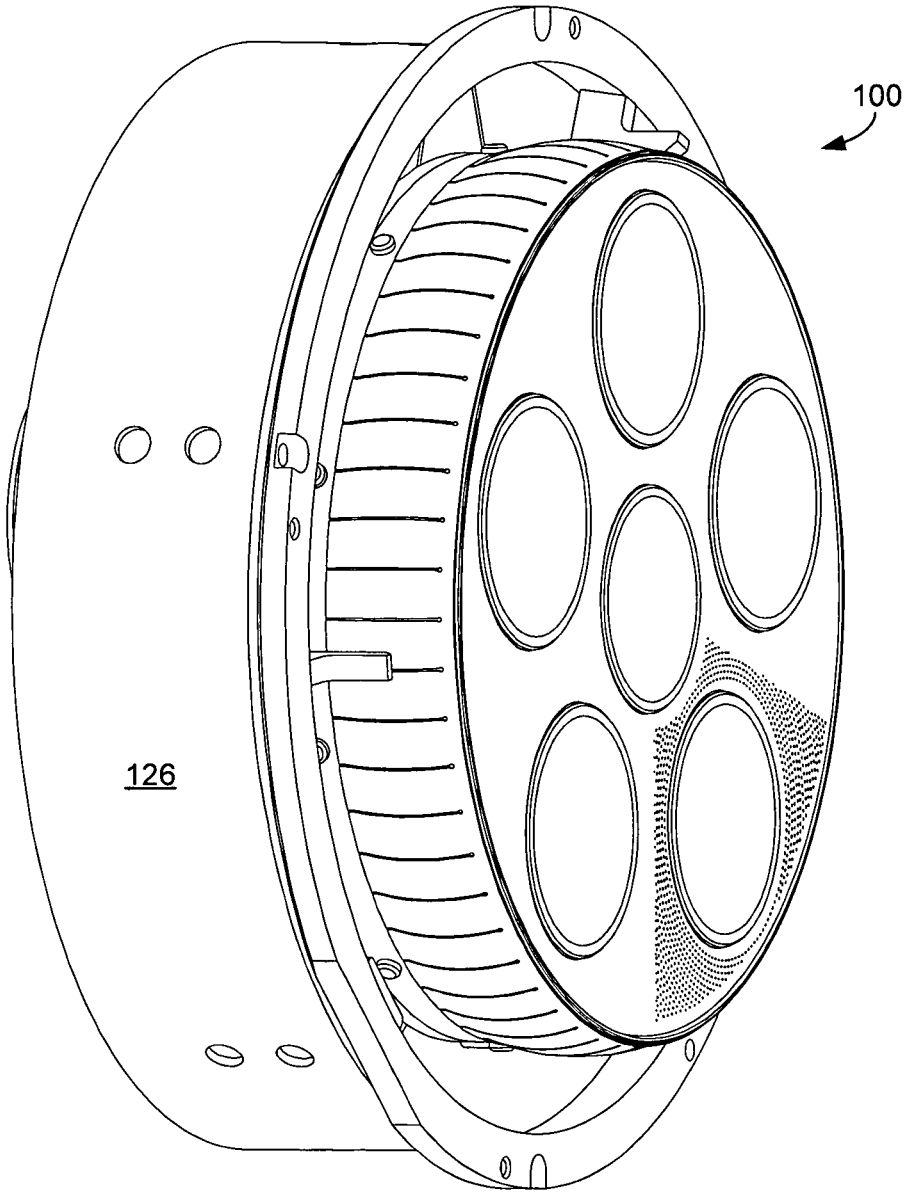
FIG. 2 depicts an alternate perspective view of the combustor end cap assembly of FIG. 1 in accordance with an embodiment of the present invention.
Figure 3:
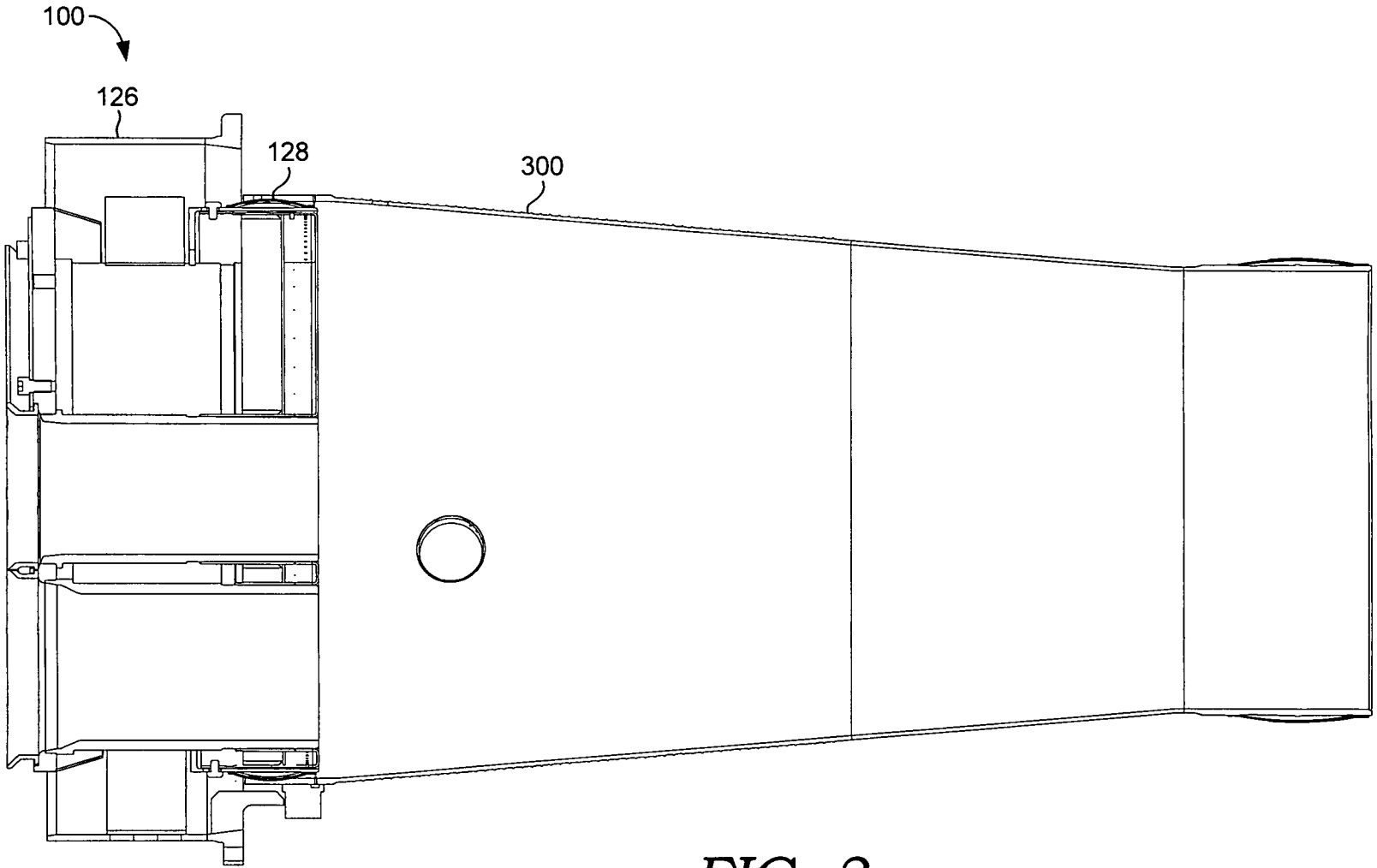
FIG. 3 depicts a cross section of a portion of a gas turbine combustor in which an embodiment of the present invention operates.

Referring initially to FIGS. 1 and 2, an end cap assembly 100 for use in a gas turbine combustor is shown in perspective view. The end cap assembly 100 mates to a combustion liner 300, as depicted in FIG. 3. The combustion system also comprises a plurality of fuel nozzles, which are coupled to an end cover (not shown), where the plurality of fuel nozzles direct a fuel supply into the end cap assembly 100, where the fuel mixes with air. The fuel and air mixture is directed into the combustion liner 300 where it is ignited. The hot combustion gases pass from the combustion liner 300 into a transition duct (not pictured), which serves to orient the hot gas flow into a turbine. The hot gases drive the turbine, which is coupled to a compressor through an engine shaft located generally along a centerline of the engine. The end cap assembly 100 serves as a pressure boundary to the combustion liner 300. That is, the end cap assembly 100 permits a flow of air into the combustion liner 300, but this flow of air undergoes one or more pressure drops through the end cap assembly 100 before entering the combustion liner 300. This process ensures that the flow of air is at an acceptable rate for mixing and reacting with the fuel injected by the fuel nozzles while cooling the end cap assembly.

Figure 4:
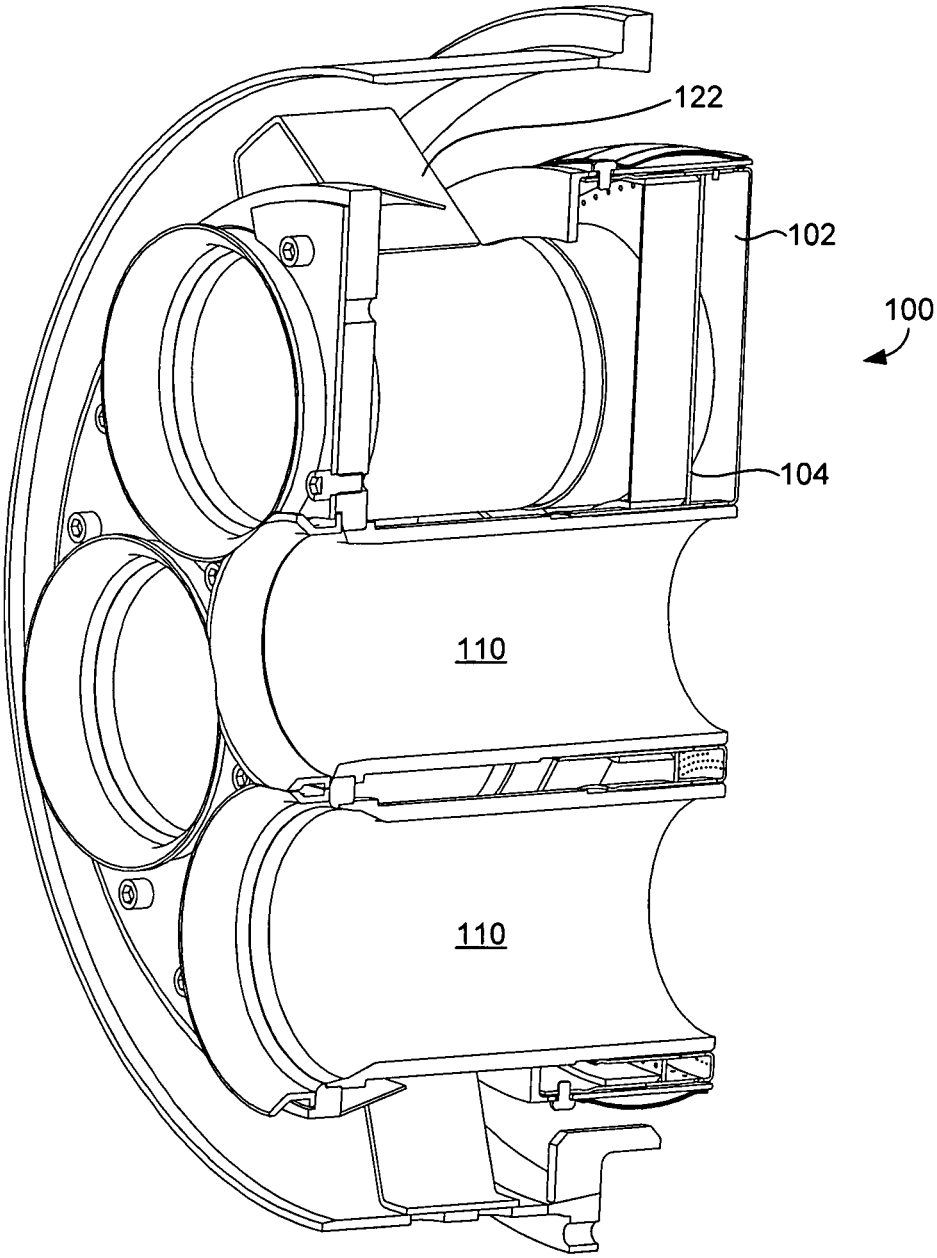
FIG. 4 depicts a cross section view shown in perspective of the combustor end cap assembly depicted in FIGS. 1 and 2.
Figure 5:
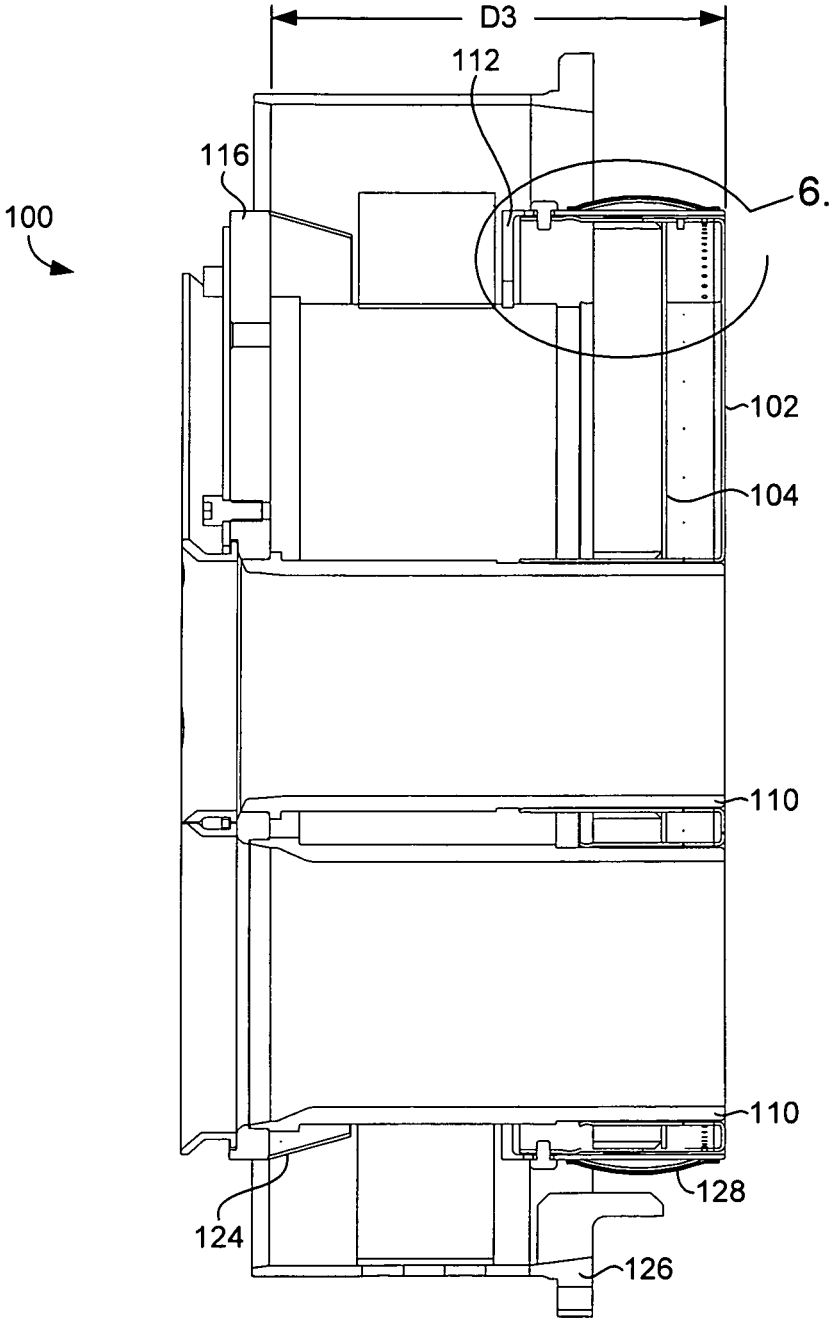
FIG. 5 depicts a cross section view of the combustor end cap assembly depicted in FIGS. 1 and 2.
Figure 6:
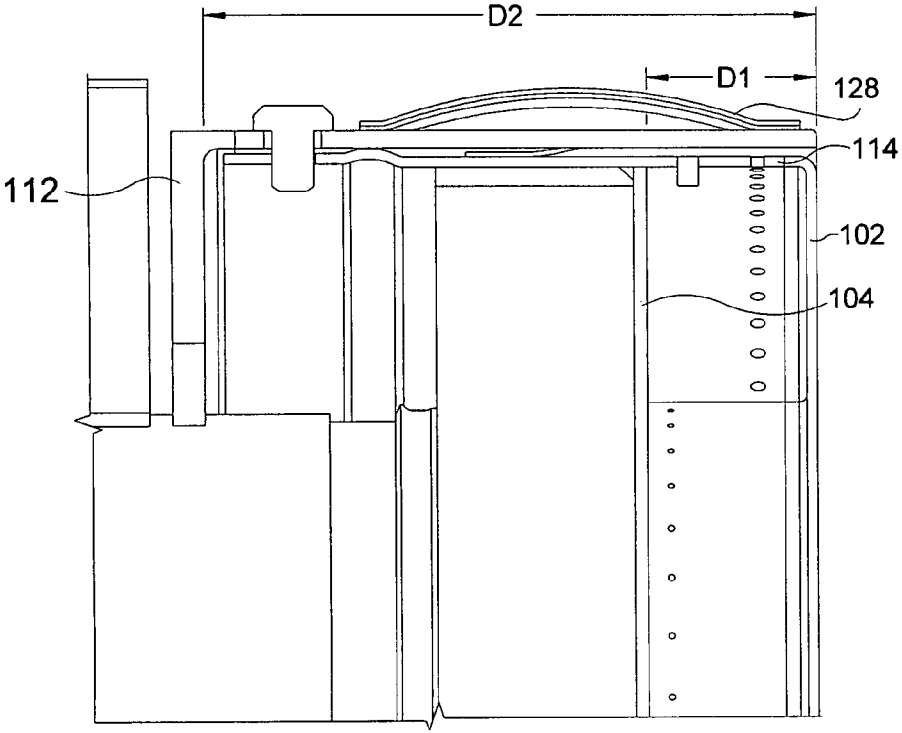
FIG. 6 depicts a detailed cross section view of a portion of the combustor end cap assembly depicted in FIG. 5.

The pressure drops taken across the end cap assembly 100 are taken in a manner so as to also improve cooling to a surface of the end cap that is directly exposed to the combustion process. Referring initially to FIGS. 4-6, which are various cross sections of an embodiment of the end cap assembly 100, the end cap assembly 100 comprises an effusion plate 102 and an impingement plate 104 that is oriented generally parallel to the effusion plate 102. For the embodiment of the present invention depicted, the end cap assembly 100 is generally circular. However, the invention is not necessarily limited to this shape.

Figure 9:
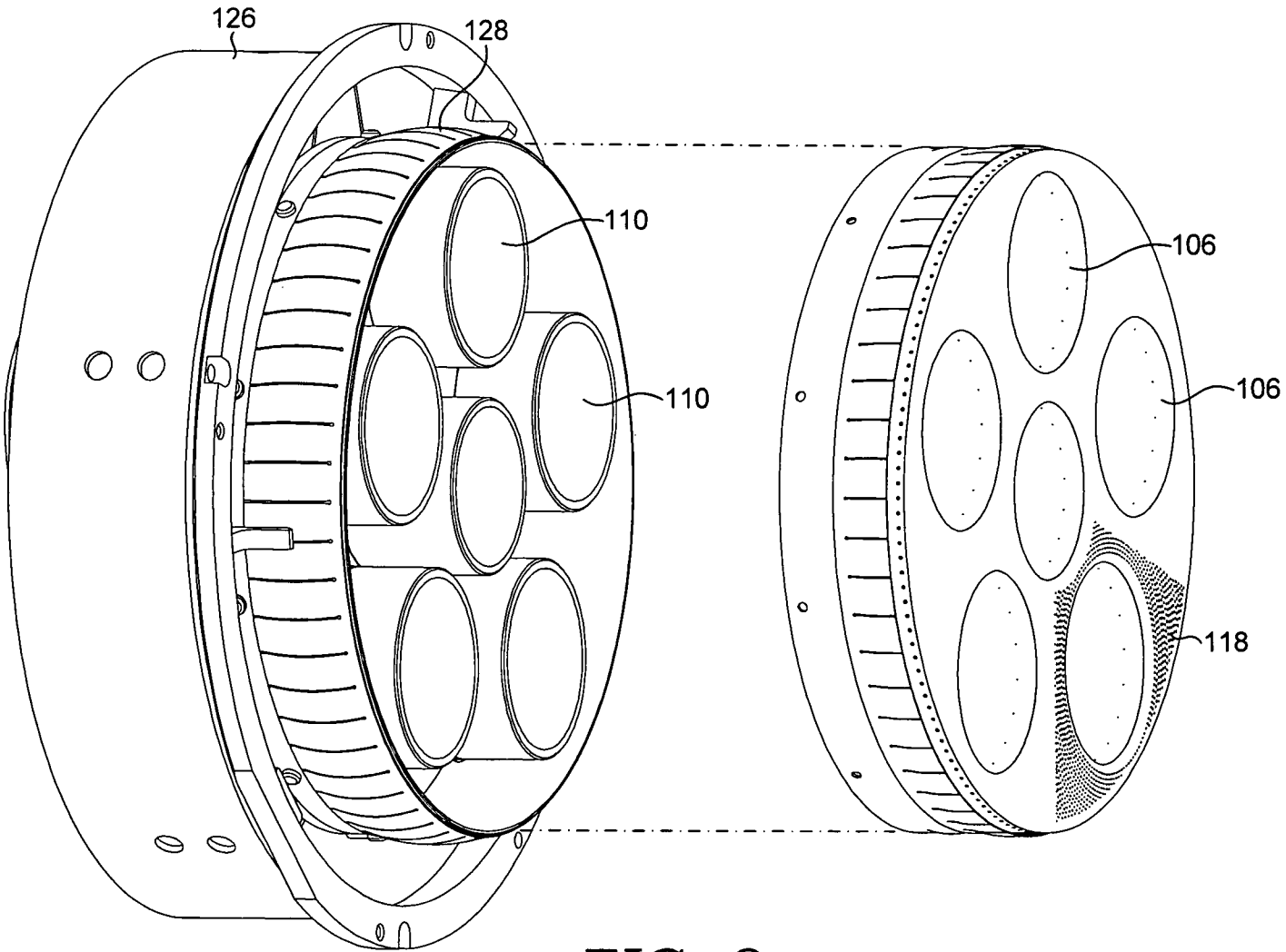
FIG. 9 depicts an exploded view of two sub assemblies of the combustor end cap assembly in accordance with an embodiment of the present invention; and, FIG. 10 depicts a further exploded view of a sub-assembly of the combustor end cap assembly depicted in FIG. 9 in accordance with an embodiment of the present invention.
Figure 10:
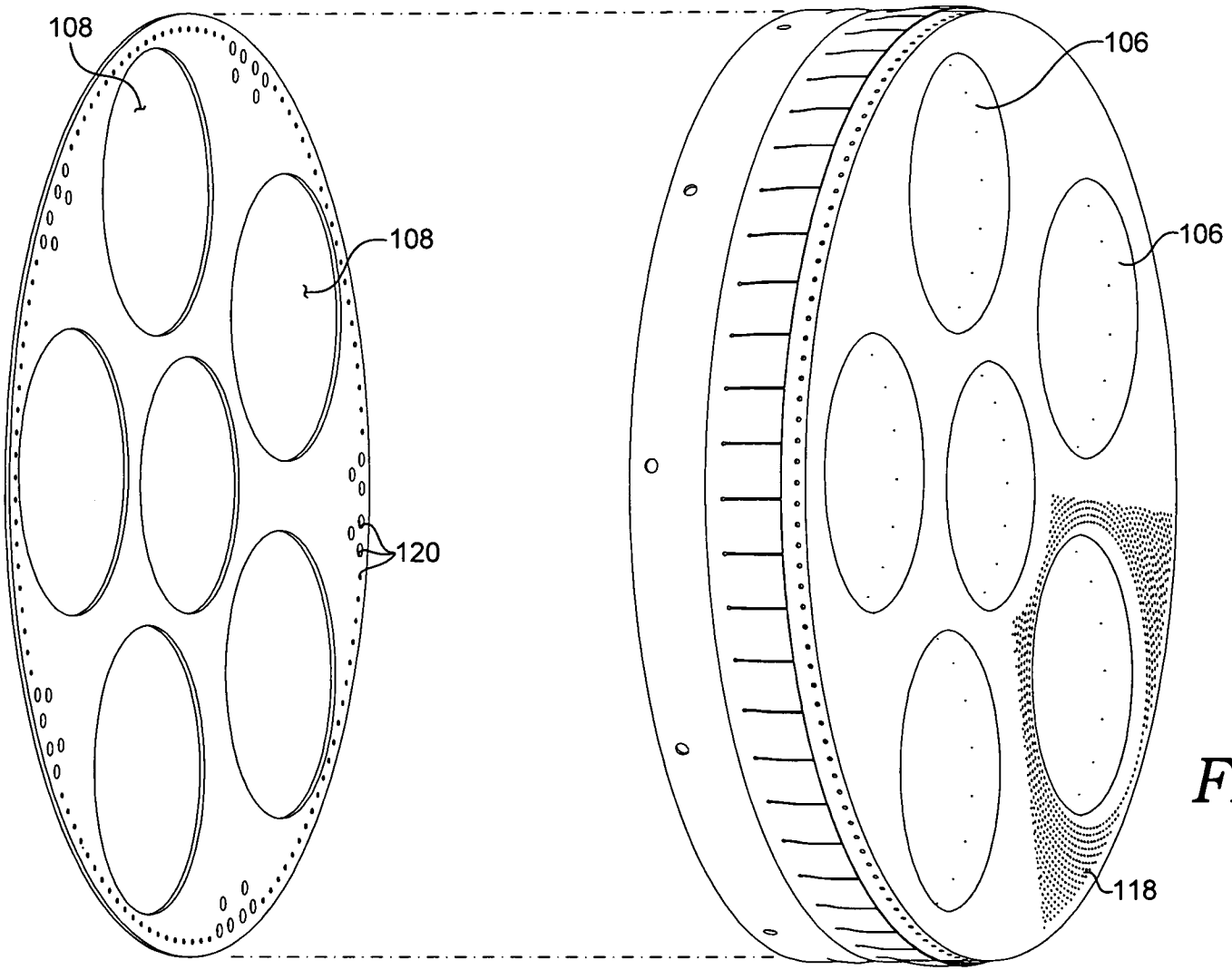

The impingement plate 104 is spaced a first axial distance D1 from the effusion plate 102. The effusion plate 102 has a first plurality of premix tube holes 106 and the impingement plate 104 has a second plurality of premix tube holes 108, as shown in FIGS. 9 and 10. The exact quantity, size, and location of the premix tube holes 106 and 108 depend on the quantity of fuel nozzles being used in the combustor. However, it is preferred that the quantity of premix tube holes in the impingement plate 104 correspond to the quantity of premix tube holes in the effusion plate 102. For the embodiment shown in FIGS. 9 and 10, a central premix tube hole is located along a center axis of the combustor and is surrounded by five equally-spaced premix tube holes.

Referring back to FIGS. 4 and 5, the end cap assembly 100 also comprises a plurality of premix tubes 110 that extend from the first plurality of premix tube holes 106 in the effusion plate 102 and through the second plurality of premix tube holes 108 in the impingement plate 104. The plurality of premix tubes 110 include a centermost tube and a circular array of premix tubes spaced about the centermost tube. As will be discussed in more detail below, the premix tubes 110 provide a region in which fuel and air can mix prior to passing into the combustion liner 300.

In an embodiment of the present invention, a forward support structure 112 is positioned generally parallel to the impingement plate 104 and spaced a second axial distance D2 from the effusion plate 102, as depicted in FIG. 6. The forward support structure 112 is attached to the plurality of premix tubes 110 by a means such as welding so as to provide stiffness and structural stability to the end cap assembly 100.

Figure 7:
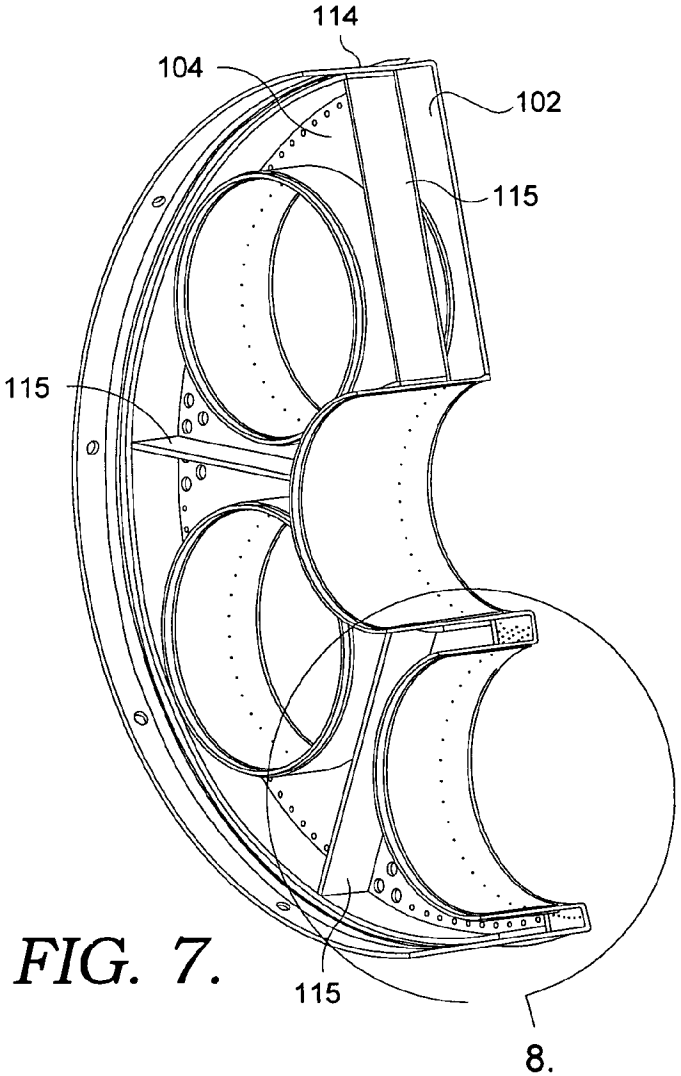
FIG. 7 depicts a cross section view shown in perspective of a portion of the combustor end cap assembly in accordance with an embodiment of the present invention.

Extending generally between the forward support structure 112 and the effusion plate 102 is a generally cylindrical sleeve 114. This generally cylindrical sleeve 114 is shown in more detail in FIGS. 6-8. Extending radially between the centermost premix tube 110 in FIG. 4 and the generally cylindrical sleeve 114 are a plurality of struts 115. These struts 115 are used to provide structural integrity to the end cap assembly. The impingement plate 104 is positioned along and welded to the generally cylindrical sleeve 114. The exact location along the generally cylindrical sleeve 114 at which the impingement plate 104 is fixed can vary, as will be discussed in more detail below. In order to provide effective cooling and structural support to the end cap assembly 100, it is necessary for the impingement plate to be positioned between the forward support structure 112 and the effusion plate 102 such that the distance D2 is greater than the distance D1.

This embodiment of the end cap assembly 100 also comprises a rear plate 116 that is positioned generally parallel to the forward support structure 112 and is spaced a third axial distance D3 from the effusion plate 102, as shown in FIG. 5. The rear plate 116 is located adjacent to an end of the plurality of premix tubes 110, opposite of the first plurality of premix tube holes 106.

As previously discussed, the end cap assembly 100 is designed as a pressure boundary leading to the combustion liner 300. As such, a portion of the end cap assembly 100, specifically the effusion plate 102, is directly exposed to the hot combustion gases contained within the combustion liner 300. Therefore, in order to avoid cracking and thermal metal fatigue (TMF) of the effusion plate 102, it is necessary to provide the effusion plate 102 with sufficient cooling. The air directed to cool the effusion plate 102 can then be used in the combustion process within the combustion liner 300.

Figure 8:
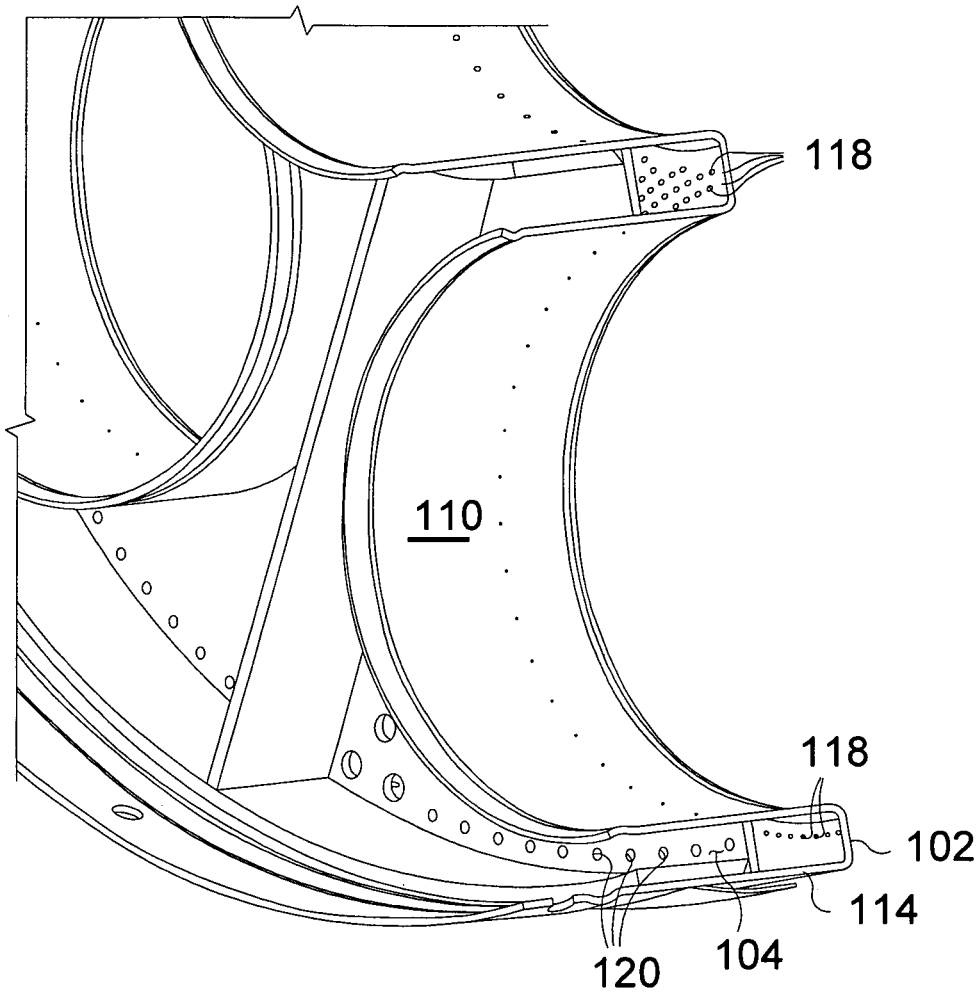
FIG. 8 depicts a detailed cross section view shown in perspective of a portion of the combustor end cap assembly depicted in FIG. 7 in accordance with an embodiment of the present invention.

Referring now to FIGS. 8-10, additional features of the effusion plate 102 can be seen. The effusion plate 102 further comprises a first plurality of cooling holes 118. These cooling holes are placed throughout the effusion plate 102 so as to cool the entire surface of the effusion plate 102. For the embodiment depicted by the end cap assembly 100, the first plurality of cooling holes 118 comprises nearly 4000 holes having a diameter of approximately 0.025 inches, with the holes angled relative to the second plurality of cooling holes 120. It is important to note that these dimensions are merely an example of a cooling configuration for an effusion plate and the present invention is not in any way limited to only this configuration. However, it is well understood that an effusion plate typically utilizes cooling holes oriented at an angle so as to provide an increased surface area for the cooling fluid to contact/pass through to more effectively cool the plate. The exact quantity, angle, and hole diameter will vary depending on the amount of cooling fluid available, operating temperatures, and desired pressure drop across the effusion plate 102. Also, depending on the cooling requirements, a thermal barrier coating can also be applied to the surface of the effusion plate 102 that is exposed to the combustion process.

The impingement plate 104 of the end cap assembly 100 further comprises a second plurality of cooling holes 120, which are depicted in FIGS. 8 and 10. Unlike the first plurality of cooling holes 118 in the effusion plate 102, the second plurality of cooling holes 120 in the impingement plate 104 are oriented generally perpendicular to a surface of the impingement plate 104. For the present invention, the second plurality of cooling holes 120 is the first location in the end cap assembly 100 that a cooling fluid, which is ultimately intended for the effusion plate 102, undergoes a pressure drop. The position of the impingement plate 104 and the second plurality of cooling holes 120 allows the cooling fluid to remain at a higher pressure in and around the end cap assembly 100. By taking a pressure drop adjacent to the effusion plate 102, the pressure drop creates a jet of cooling flow through the second plurality of cooling holes 120. Based on the proximity of the impingement plate 104 to the effusion plate 102, this jet of cooling flow can penetrate a distance so as to directly contact areas of the effusion plate 102. Furthermore, by positioning the second plurality of cooling holes 120 at specific locations around the impingement plate 104, the jet of cooling flow can be targeted so as to directly impinge on specific locations of the effusion plate 102, such as along an outer perimeter of the effusion plate 102. This improves the cooling effectiveness of the cooling fluid on the effusion plate to prevent overheating or thermal mechanical fatigue of the effusion plate 102.

For the embodiment of the present invention depicted in the FIGS., the second plurality of cooling holes 120 comprises approximately 130 holes located generally about the perimeter of the impingement plate 104 and proximate the plurality of struts 115, since an area of concern requiring additional cooling for an embodiment of the end cap assembly 100 is the perimeter regions of the effusion plate 102 and area between the premix tubes 110.

Furthermore, a portion of the second plurality of cooling holes 120 have a larger diameter so as to direct an increased cooling fluid supply to a portion of the effusion plate 102. For an embodiment depicted in FIG. 8, the portion of the cooling holes having a larger diameter are located proximate the plurality of struts 115. Using larger hole diameters will ensure that a larger volume of cooling air is directed to areas in-line with the larger holes and that are operating at higher temperatures. For this embodiment, the second plurality of cooling holes 120 are positioned so as to reduce large thermal gradients that are present in the effusion plate 102. However, the location of the second plurality of cooling holes 120 depicted in FIGS. 8 and 10 is not meant to be the only configuration or arrangement of the cooling holes 120. In fact, the quantity, spacing, and size of the second plurality of cooling holes 120 can vary depending on a variety of factors such as the supply pressure of the cooling fluid, the desired jet penetration onto the effusion plate 102, desired pressure drop, and locations of high operating temperatures.

The effectiveness of the cooling fluid flow is also a function of the distance between the impingement plate 104 and the effusion plate 102. For the embodiment depicted herein, the impingement plate 104 is located approximately one inch from the effusion plate 102. However, the position of the impingement plate 104 can vary depending on the desired effect of the cooling fluid penetration onto the effusion plate 102. For example, the impingement plate 104 can be closer to the effusion plate 102, such as within approximately a quarter of an inch to provide more discrete jets of cooling flow onto the effusion plate 102, or further away, such as up to three inches from the effusion plate 102 for a more distributed flow of the cooling fluid.

The end cap assembly 100 is inserted into a combustion liner 300 as shown in FIG. 3. A plurality of fuel nozzles (not shown) are inserted into the plurality of premix tubes 110. In operation, a flow of cooling fluid, such as air, passes along the outer surface of the combustion liner 300, thereby cooling the surface of the combustion liner 300. The air travels towards the end cover containing the fuel nozzles and the end cap assembly 100. This air flow is indicated by the arrows in FIG. 3. A portion of the air enters the plurality of premix tubes 110, where it mixes with fuel from the plurality of fuel nozzles, while the remaining air enters the end cap assembly 100 through a circumferential opening 122. The air then passes around the plurality of premix tubes 110, through the second plurality of cooling holes 120 in the impingement plate 104, so as to contact a surface of and cool the effusion plate 102. The air passes through the first plurality of openings 118 in the effusion plate 102 in order to further cool the effusion plate 102. The air then passes into the combustion liner 300 where it mixes with the products from the premix tubes 110 and reacts.

In an embodiment of the present invention, the end cap assembly 100 also comprises additional features such as a flow shield 124 that is attached to the rear plate 116. The flow shield 124 is positioned to encourage the cooling air flow that does not enter through the circumferential opening 122 to maintain its flow along the outer edge of the end cap assembly and enter into the plurality of premix tubes 110. Another feature of an embodiment of the present invention is an outer support ring 126. The outer support 126 is used for securing the end cap assembly 100 to the end cover and combustion case of the combustor. Also, as it can be seen from FIG. 3, the end cap assembly 100 is sealed to the combustion liner 300 by one or more flexible spring seals 128. These spring seals 128 provide a surface capable of compressing during installation of the end cap assembly 100 in the combustion liner 300 and allow for relative thermal growth between the parts.

The present invention has been described in relation to particular embodiments, which are intended in all respects to be illustrative rather than restrictive. Alternative embodiments will become apparent to those of ordinary skill in the art to which the present invention pertains without departing from its scope.

From the foregoing, it will be seen that this invention is one well adapted to attain all the ends and objects set forth above, together with other advantages which are obvious and inherent to the system and method. It will be understood that certain features and sub-combinations are of utility and may be employed without reference to other features and sub-combinations. This is contemplated by and within the scope of the claims.

What is claimed is:

1. An end cap assembly for use in a combustion system comprising:

a generally cylindrical sleeve;

an effusion plate having a first plurality of cooling holes and a first plurality of premix tube holes, the effusion plate joined to an end of the cylindrical sleeve;

an impingement plate having a second plurality of cooling holes and a second plurality of premix tube holes, wherein the second plurality of cooling holes comprises a first portion and a second portion, the second portion of the second plurality of cooling holes having a larger diameter than the first portion of the second plurality of cooling holes, the second portion being located proximate a plurality of struts of the end cap assembly, the impingement plate joined to the cylindrical sleeve and oriented generally parallel to the effusion plate and spaced a first axial distance from the effusion plate;

a plurality of premix tubes extending from proximate the first plurality of premix tube holes in the effusion plate and through the second plurality of premix tube holes in the impingement plate; and, wherein a supply of cooling fluid is directed through the second plurality of cooling holes in the impingement plate, onto the effusion plate, through the first plurality of cooling holes, and into a combustion liner.

2. The end cap assembly of claim 1, wherein the cylindrical sleeve extends a distance beyond the impingement plate.

3. The end cap assembly of claim 1, wherein the second plurality of cooling holes are oriented generally perpendicular to a surface of the impingement plate.

4. The end cap assembly of claim 3, wherein the first plurality of cooling holes are oriented at an angle relative to the second plurality of cooling holes.

5. The end cap assembly of claim 1, wherein the portion of the second plurality of cooling holes provide regions of increased cooling fluid to the effusion plate.

6. The end cap assembly of claim 1, further comprising a forward support structure positioned generally parallel to the impingement plate, spaced a second axial distance from the effusion plate, and fixed to the plurality of premix tubes, and a rear plate positioned generally parallel to the forward support structure and spaced a third axial distance from the effusion plate, the rear plate located adjacent to an end of the plurality of premix tubes opposite of the first plurality of premix tube holes.

7. The end cap assembly of claim 1 further comprising one or more seals extending about a perimeter of the cap assembly.

8. An end cap assembly comprising:

an effusion plate having a first plurality of cooling holes and a first plurality of premix tube holes;

an impingement plate having a second plurality of cooling holes and a second plurality of premix tube holes, wherein the second plurality of cooling holes comprises a first portion and a second portion, the second portion of the second plurality of cooling holes having a larger diameter than the first portion of the second plurality of cooling holes, the second portion being located proximate a plurality of struts of the end cap assembly, the impingement plate oriented generally parallel to the effusion plate and spaced a first axial distance from the effusion plate;

a plurality of premix tubes extending from the first plurality of premix tube holes in the effusion plate and through the second plurality of premix tube holes in the impingement plate;

a forward support structure positioned generally parallel to the impingement plate and spaced a second axial distance from the effusion plate, the forward support structure being fixed to the plurality of premix tubes;

a generally cylindrical sleeve extending between the forward support structure and the effusion plate;

the plurality of struts extend radially between a centermost premix tube and the cylindrical sleeve; and, a rear plate positioned generally parallel to the forward support structure and spaced a third axial distance from the effusion plate, the rear plate located adjacent to an end of the plurality of premix tubes opposite of the first plurality of premix tube holes;

wherein a supply of cooling fluid is capable of being directed radially inward between the rear plate and the forward support structure, through the second plurality of cooling holes in the impingement plate, and onto the effusion plate for cooling the effusion plate.

9. The end cap assembly of claim 8, wherein the second plurality of cooling holes are oriented generally perpendicular to a surface of the impingement plate.

10. The end cap assembly of claim 9, wherein the first plurality of cooling holes are oriented at an angle relative to the second plurality of cooling holes.

11. The end cap assembly of claim 8, wherein the second axial distance is greater than the first axial distance.

12. The end cap assembly of claim 8 further comprising a flow shield that extends from the rear plate and is angled radially inward towards the plurality of premix tubes.

13. The end cap assembly of claim 8 further comprising one or more seals extending about a perimeter of the end cap assembly.

14. A method of cooling a combustion end cap assembly comprising:

providing an end cap assembly having an effusion plate with a first plurality of cooling holes and a first plurality of premix tube holes, an impingement plate with a second plurality of cooling holes spaced about a perimeter of the impingement plate and adjacent a plurality struts of the end cap assembly and a second plurality of premix tube holes, wherein the second plurality of cooling holes comprises a first portion and a second portion, the second portion of the second plurality of cooling holes having a larger diameter than the first portion of the second plurality of cooling holes, the second portion being located proximate the plurality of struts of the end cap assembly;

providing a plurality of premix tubes extending from the first plurality of premix tube holes and through the second plurality of premix tube holes, a forward support structure positioned generally parallel to the impingement plate, the forward support structure being fixed to the plurality of premix tubes, a generally cylindrical sleeve extending between the forward support structure and the effusion plate, the plurality of struts extend radially between a centermost premix tube and the generally cylindrical sleeve, and a rear plate positioned generally parallel to the forward support structure and proximate an end of the plurality of premix tubes;

directing a supply of cooling fluid into the end cap assembly, around the plurality of premix tubes, and towards the impingement plate;

directing the supply of cooling fluid through the second plurality of cooling holes in a direction perpendicular to a surface of the impingement plate; and, directing the supply of cooling fluid through the first plurality of cooling holes in a direction having an angle relative to a surface of the effusion plate.

15. The method of claim 14, wherein the supply of cooling fluid is directed radially inward between the forward support structure and the flow shield.

16. The method of claim 14, wherein the second plurality of cooling holes have a diameter greater than the first plurality of cooling holes.

* * * * *